United States Patent [19]

Schmutzer et al.

[11] 4,189,663

[45] Feb. 19, 1980

[54] DIRECT CURRENT BALLASTING AND STARTING CIRCUITRY FOR GASEOUS DISCHARGE LAMPS

[75] Inventors: Joel Schmutzer, Oak Park, Ill.; George D. Elkerton, Edmonds, Wash.

[73] Assignee: Forest Electric Company, Melrose Park, Ill.

[21] Appl. No.: 946,760

[22] Filed: Sep. 28, 1978

Related U.S. Application Data

[62] Division of Ser. No. 696,400, Jun. 15, 1976, Pat. No. 4,132,925.

[51] Int. Cl.[2] ..... H05B 41/16

[52] U.S. Cl. ..... 315/205; 315/105; 315/244; 315/276; 315/DIG. 5

[58] Field of Search ..... 315/94, 97, 105, 200 R, 315/205, 208, 276, 278, 287, DIG. 5, 244; 363/45

[56] References Cited

U.S. PATENT DOCUMENTS

| | | | |
|---|---|---|---|
| 2,586,401 | 2/1952 | Waguet | 315/97 |
| 3,066,241 | 11/1962 | Palmer | 315/99 |
| 3,219,880 | 11/1965 | Pett | 315/240 |
| 3,233,148 | 2/1966 | Lake | 315/205 X |
| 3,238,415 | 3/1966 | Turner | 315/160 |
| 3,569,775 | 3/1971 | Halsted | 315/105 |
| 3,689,827 | 9/1972 | Quinn | 315/276 X |
| 3,767,970 | 10/1973 | Collins | 315/DIG. 5 |
| 3,801,867 | 4/1974 | West et al. | 315/DIG. 5 |
| 3,903,452 | 9/1975 | Nakai | 315/205 X |
| 4,001,637 | 1/1977 | Gray | 315/205 |

*Primary Examiner*—Eugene R. LaRoche

*Attorney, Agent, or Firm*—McWilliams, Mann & Zummer

[57] ABSTRACT

Direct current ballasting and starting circuitry for efficiently operating a gaseous discharge lamp on direct current. Series-pass switching means in one of a pair of input lines alternatively switches between on and off states to periodically supply pulses of energy from a source of direct current voltage. During steady-state operation, current sensing means limits the maximum current conductable by said switching means such that the output of the circuitry is current regulated. Starting means, in series connection between the filter means and an output terminal, senses the nonionized state of the lamp and provides a voltage pulse of sufficient magnitude and duration to initiate ionization in the lamp. Various forms of control means or drive means for controlling the conductive state of the switching means are disclosed.

An A.C. to D.C. power conversion circuit, for operating a plurality of ballasting and starting circuits therefrom, utilizes a portion of a primary winding of a transformer for connection to the A.C. voltage source. A stepped up A.C. voltage across the entire primary winding is applied to a rectification means, which rectifies the A.C. voltage and supplies the same to a filter means. The filter means provides a D.C. voltage for input to the ballasting and starting circuits. A center-tap on a secondary winding of the transformer is referenced to the second of a pair of input lines of the ballasting and starting circuit, and the ends of the secondary winding provide a small A.C. voltage to the cathodic heater element of the lamp.

2 Claims, 3 Drawing Figures

DIRECT CURRENT BALLASTING AND STARTING CIRCUITRY FOR GASEOUS DISCHARGE LAMPS

This application is a division of our application Ser. No. 696,400, filed June 15, 1976, now U.S. Pat. No. 4,132,925, granted Jan. 2, 1979.

BACKGROUND OF THE INVENTION

This invention relates in general to ballasting and starting circuitry for operating gaseous discharge lamps from D.C., and more particularly to such circuitry with a current-regulated output characteristic wherein series-pass switching means is alternatively switched between on and off conductive states and to A.C. and D.C. power conversion circuits for supplying direct current to a plurality of ballasting and starting circuits.

At the present time, use of A.C. power sources to power gaseous discharge tubes, especially those used in fluorescent lighting, by far exceed the use of D.C. power sources. This is not particularly surprising because A.C. power sources are usually more readily available than D.C. power sources. However, operation of fluorescent lamps from A.C. power sources has a number of disadvantages. One of these problems is that fluorescent lamps generate and radiate radio frequency interference (RFI). RFI is a form of electro-magnetic radiation, which among other things is known for interferring with the performance of communications systems, e.g. radio and television. The RFI is generated because, as the A.C. changes or reverses polarity during a portion of each cycle, the arc between the electrodes of the gaseous discharge tube extinguishes. The tube must then be restarted for current flow in the opposite direction and much of the RFI is generated when the arc between the electrodes of the gaseous discharge tube begins to restrike.

The constant polarity reversal of voltage and current in an A.C. power source also requires that heating be provided at both electrodes of the gaseous discharge tube. To condition a gaseous discharge tube for the striking of an arc between the electrodes, it is necessary to heat the cathodic electrode to facilitate electron emission. However, in an A.C. system, the electrode of the tube which is the cathodic electrode is constantly changing as the polarity of the voltage and current change. This necessitates the heating of both terminals.

Because the arc between the terminals of the gaseous discharge tube operating from an A.C. power source is constantly being extinguished and then reignited, lighting from a fluorescent lamp is not continuous. Instead, the lamp actually flickers. This flickering phenomenom is not noticeable to the unaided eye because the frequency of most A.C. power sources is somewhat above a frequency level which is perceptible. Nonetheless, recent behavorial and physiological studies have indicated that the inherent flickering has undesireable side-effects. Behavior and activity of children tending to be hyperactive are believed to be aggravated by the flickering. The flickering is also believed to hasten fatigue, which is a serious problem to medical personnel when attempting to differentiate between the various shadings of x-ray films.

The flickering phenomenom further causes stroboscopic effects when any movement is related to a harmonic of the A.C. power source frequency. This can present a safety hazard because the stroboscopic effects cause rotating machinery to appear to be either stationary or slowly rotating.

Even when operating from an A.C. power source, fluorescent lamps require circuitry to power and control the lamp because of the unusual load characteristics of gaseous discharge tubes. To achieve arcing between the electrodes of a gaseous discharge tube, the striking voltage of the tube must be exceeded. The striking voltage is often twice the voltage at which the tube will operate once striking of the arc between the terminals of the tube occurs. Circuitry must be provided to generate a voltage pulse of sufficient magnitude and duration to achieve striking. However, when striking of the arc occurs, current to the tube must then be limited. The current limiting function is often provided in A.C. circuits by a high leakage reactance transformer, which may constitute the bulk of the weight and expense in a fluorescent system. Gaseous discharge tubes are not susceptible to voltage regulation once arcing between the electrodes thereof is initiated because of the negative impedance characteristic of the tube. The tube will conduct an excessive amount of current to the point of self-destruction. Therefore the current to a fluorescent lamp must be limited and the particular load characteristic of the lamp will determine the voltage at which it operates at a regulated current level. For a given current, the operating voltage of the tube is a function of the length of the tube, its diameter, the types of gases within the tube and a number of other factors.

Some prior art efforts have been concerned with operating gaseous discharge tubes in conjunction with D.C. ballasting and starting circuits. These efforts have been generally centered around biasing a series pass semiconductor, usually a transistor, such that the current therethrough is limited to the desired current through the gaseous discharge tube. To compensate for a number of variables in such circuit design and the expected variations in the D.C. power source, a relatively large voltage is usually dropped across the series pass transistor. Hence, the series-pass transistor must dissipate a significant amount of power. This power is wasted energy and leads to a low efficiency of operation for the circuit. The power dissipation also requires the use of larger and more expensive semiconductors for the series-pass element. This further requires a heat sink to dissipate the heat from the transistor, and some instances, forced air ventilation thereof. Thus, such prior art ballasting and starting circuits have not met with much acceptance or commercial success, except in quite limited or specialized applications.

SUMMARY OF THE INVENTION

The direct current ballasting and starting circuitry of the present invention employs a series-pass switching means in one of a pair of input lines. The circuit provides a regulated output current. The switching means or semiconductor is alternately switched between on and off conductive states. During the off state, no current is conducted through the series-pass semiconductor and during the on stage the voltage drop thereacross is very small. The power lost in the series-pass semiconductor is very minimal. Thus there is no need for massive heat sinks or for large semiconductors capable of withstanding and dissipating higher power losses, as in the prior art circuits. Means of limiting the current conducted by the switching means is accomplished by current sensing means in series connection with switching means. Filtering means are in series with the current sensing means for smoothing pulses of energy delivered by the switching means for the D.C. voltage source. The filter means has a direct current output with a comparatively small alternating current component thereon.

The starting circuitry is in series connection between the filter means and an output terminal of the circuitry for sensing the nonionized condition of a lamp connectible to the output terminal. The starting circuitry further provides a voltage pulse of sufficient magnitude and duration to initiate ionization within the lamp. Once ionization is achieved, the starting circuit becomes inactive and does not impede the supply of direct current from the filter means to the lamp.

Various means for controlling the on and off conductive states of the series-pass switching semiconductor may be utilized, as disclosed in our said application. In one embodiment, an oscillator is momentarily responsive to excitation provided by the starting voltage pulse at one of the output terminals and therafter interacts with the switching means. The oscillator has a resonant tank circuit for controlling the series pass semiconductor and the tank circuit is also phase-corrected to provide the series pass semiconductor with a 70 percent duty cycle to insure that sufficient power is available from the circuit.

Another embodiment of the control means utilizes a free-running multivibrator, the output of which is pulse-width modulated to control the on-off states of the series-pass semiconductor.

Where a plurality of ballasting and starting circuits are used, a single starting circuit may be used to generate the striking voltage pulses for all of the ballasting circuits. Secondary windings of pulse transformers are in series connection with an output line of each ballasting circuit. Primary windings are connected in series between an energy storage means and a voltage responsive means. A diode from the output line of each ballasting circuit is poled in a logic "or" configuration such a nonionized condition in any lamp associate with its ballasting circuit will charge the energy storage means to a voltage level which will render the voltage responsive means conductive, thereby discharging the energy storage means through the primary windings of the pulse transformers and starting the desired lamp.

A power conversion circuit for converting A.C. voltage to a suitable D.C. voltage for operation of the ballasting and starting circuitry is also disclosed. A portion of a primary winding of a transformer is tapped for applying the A.C. voltage source thereacross. The entire primary winding is applied to rectification means for rectifying the A.C. voltage and supplying the same to a filter means. The filter means supplies an elevated D.C. voltage level to a plurality of D.C. ballasting and starting circuits. A secondary winding of the transformer supplies a considerably lower A.C. voltage level to the cathodic electrode of the lamp associated with each ballasting and starting circuit for heating the same. The secondary winding of the transformer is center-tapped, with the center-tap reference to a second of the input lines of the ballasting and starting circuitry. Thus the cathode of each lamp is heated with a small A.C. voltage which is balanced with respect to the second input line thereby eliminating A.C. modulation of the D.C. current supplied to each lamp.

Various other objects, features and advantages of the invention will become apparent from the following detailed disclosure when taken in conjunction with the drawings.

DESCRIPTION OF THE PREFERRED EMBODIMENTS

Figure 1:
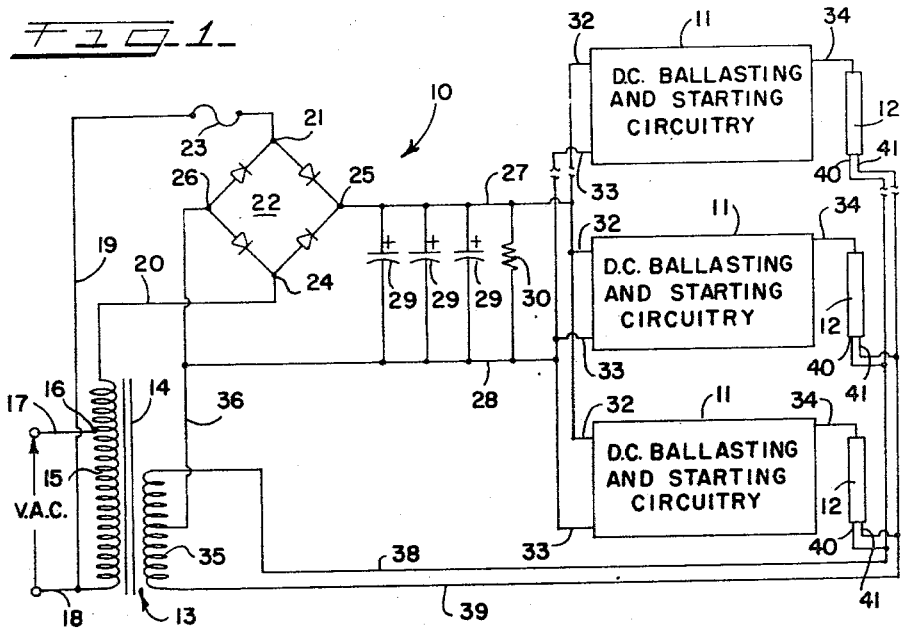
FIG. 1 is a schematic diagram of the A.C. to D.C. power conversion circuit for supplying D.C. power to a plurality of ballasting and starting circuits, each of which supplies regulated direct current to a gaseous discharge tube.

Referring to FIG. 1, there is shown an A.C. to D.C. power conversion circuit, generally designated as 10. A single circuit 10 is capable of supplying D.C. power of a suitable voltage level to a plurality of D.C. ballasting and starting circuits 11. As will be hereinafter presented, the ballasting and starting circuit 11 supplies regulated current to at least one gaseous discharge tube or fluorescent lamp 12.

The power conversion circuit 10 has a power transformer, generally designated as 13, with a core 14 of iron or other suitable magnetic material. A primary winding 15 of the transformer 13 has a tap, at a point 16. A pair of leads 17, 18, one of which is connected to the tap at point 16, supply voltage from an A.C. power source to a portion of the primary winding 15.

A pair of leads 19, 20 interconnect opposite ends of the primary winding 15 to opposite terminals 21, 24 of a rectification means, i.e. a diode rectification bridge 22. A fuse 23, in series with the lead 19, protects the circuit 10 and the circuits 11 from overload or malfunction which could result in excessive current demand.

To minimize the amount of filtering required to filter the rectified A.C. voltage, the diode bridge 22 is preferably of the full-wave type. The diodes in the bridge 22 are poled to provide a positive D.C. potential at a terminal 25 with respect to a common terminal 26. The potential between the terminals 25, 26 will typically be in the range of 145 to 190 volts D.C. Connected in parallel across a pair of leads 27, 28, which are respectively connected to the terminals 25, 26, is at least one capacitor 29 for filtering the rectified A.C. voltage from the bridge 22. Because of the magnitude of D.C. voltage between the leads 27, 28, it may be more economical to provide a plurality of capacitors 29.

A bleeder resistor 30 is usually provided in parallel with the capacitors 29 to reduce the voltage across the leads 27, 28 within a specified period of time after A.C. voltage has been removed from the leads 17, 18. The phosphor coating in some fluorescent lamps 12 will continue to fluoresce at a reduced level of illumination until the voltage across the lamp 12 is insufficient to maintain arcing between an anodic electrode (not shown) and cathodic electrode (not shown) of the lamp 12. The bleeder resistor 30 insures that within a specified period of time the voltage levels within the circuit 10 and hence the circuit 11 will be reduced to a level at which the fluorescent phenomenom will terminate.

The positive D.C. voltage lead 27 is connected to an input line 32 of each of the ballasting and starting circuits 11. The common lead 28 is similarly connected to a second input line 33 of the circuits 11. An output terminal 34 of each of the circuits 11 provides suitable power, sensing and controlling functions to power and control at least one fluorescent lamp 12 of the circuits 11, as is hereinafter described.

The power transformer 13 also has a secondary winding 35 with an A.C. voltage thereacross which is considerably lower in magnitude than that across the primary winding 15. The secondary winding 35 is center-tapped and connected by a lead 36 to the common line 28 of the circuit 10 and to the terminal 26 of the diode bridge 22. A pair of leads 38, 39 are connected to opposite ends of the secondary winding 35 and to terminals 40, 41 to heat the cathodic electrode within the lamp 12 to provide electron emission therefrom. Because the secondary winding 35 is center-tapped and referenced by a lead 36 to the common line 28, the average voltage on the cathodic electrode of any lamp 12 will be zero. Thus, A.C. voltage modulation of the potential across any lamp 12 is minimized or eliminated. Use of a center-tapped secondary winding 35 avoids the need for supplying a small D.C. voltage for heating the cathodic electrode in the lamps 12, which would require additional components such as rectifying diodes and filtering capacitors to eliminate ripple.

The secondary winding 35, while providing an A.C. voltage for heating the tube 12 also forms part of the return path for the D.C. current for the lamps 12. D.C. current supplied by the ballasting and starting circuitry 11 at the output terminal 34 flows through the tube 12 and returns to the power conversion circuit 10 through both of the leads 38, 39, the secondary winding 35, and the lead 36 to the terminal 26 of the diode bridge 22.

As previously noted, in operating fluorescent lamps 12 from an A.C. power source, both ends of the lamp 12 must be heated because the cathodic electrode in the lamp 12 changes as the polarity of the voltage and current in the lamp 12 reverse. However, in operating a lamp 12 from a D.C. power source, the polarity of the voltage and current applied to the lamp 12 remains constant. Thus, only the end of the lamp 12 which is to be the cathodic end needs to be heated. As illustrated in FIG. 1, the output terminal 34 of the ballasting and starting circuit 11 need only be applied to one terminal on the anodic end of the lamp 12 to provide electrical connection thereto.

Figure 2:
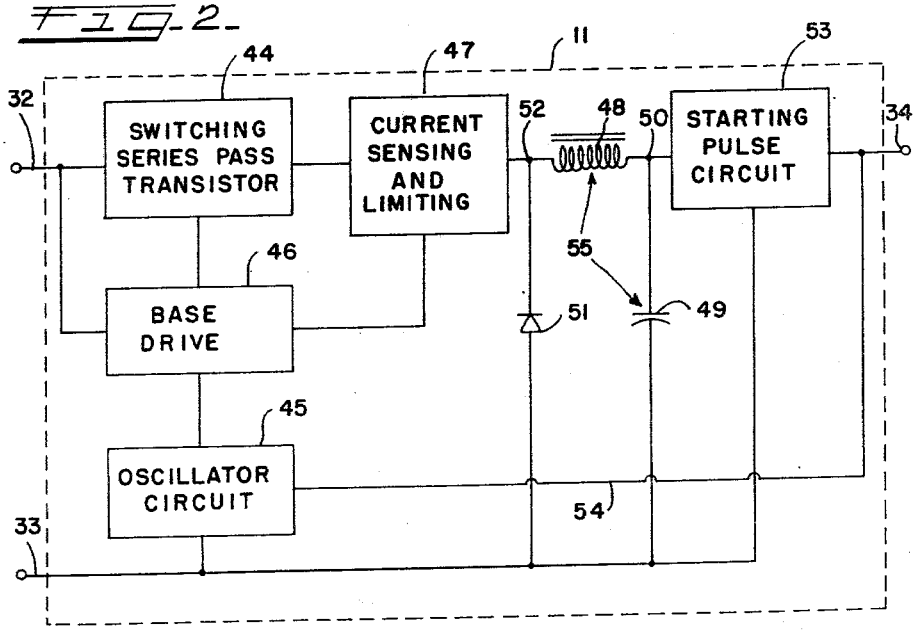
FIG. 2 is a schematic circuit diagram, mostly in block form, of a D.C. ballasting and starting circuit as illustrated in FIG. 1.

Turning now to FIG. 2, there is shown a circuit diagram, mostly in block form, of one of the D.C. ballasting and starting circuits 11 of FIG. 1. A pair of input lines 32, 33 supplies a source of D.C. voltage to the circuit 11. An output terminal 34 supplies power to the gaseous discharge tube 12, and controls and senses the condition of the gaseous discharge tube. In series with one of the input lines 32 is switching means in the form of a switching series-pass transistor 44. The switching transistor 44 is alternately switchable between on and off conductive states for periodically supplying pulses of energy from the sources of D.C. voltage. An oscillator circuit 45 in combination with base drive 46 provides a means of controlling the conductive state of switching transistor 44. Current sensing means 47 limits the maximum current through the transistor 44. One means of limiting current through the transistor 44 is by diverting the base drive 46 therefrom, to immediately switch the transistor 44 to an off conductive state. Filter means 55 includes an inductor 48 and a capacitor 49. The inductor 48 receives pulses of energy from the switching transistor 44 and in combination with the capacitor 49 filters the pulses of energy into direct current with a small alternating current component, in the form of ripple, superimposed on the direct current at a junction 50. The capacitor 49 is connected between the junction 50 and the second input line 33. A commutating diode 51 is connected between the second input 33 and a junction 52 with the diode 51 poled to maintain current continuity in the inductor 48 when the switching transistor 44 is in an off conductive state.

A starting pulse circuit 53 is biassed between the output terminal 34 and the second input 33. Because the ballasting and starting circuit 11 does not regulate voltage at the output terminal 34, but only regulates current deliverable thereto, the potential at the output terminal 34 will rise to a level similar to that at the input line 32 when the circuit 11 is first energized. The starting pulse circuit 53 senses this higher voltage level as indicative of nonionized or nonconductive condition of a lamp connectible to the output terminal 34 and thereupon generates a voltage pulse of sufficient magnitude and duration to initiate ionization in a gaseous discharge lamp. Once striking of the arc within the lamp has occurred, the voltage at the output terminal 34 drops and the output voltage is controlled and determined by the load characteristics of the particular gaseous discharge tube connected thereto. The circuit 11 will then begin operating in a current-regulated output mode. As the potential at the terminal 34 drops, the starting pulse circuit 53 will become inactive. However, should some occurrence cause a loss of arcing within the lamp, the above starting process will automatically repeat.

The oscillator 45 is connected by a lead 54 to the output terminal 34 such that the starting voltage pulse initially excites the oscillator 45, and thereafter the oscillator 45 interacts with the transistor 44 to remain in an oscillatory condition. The oscillator circuit 45 alternately aids and opposes the base drive 46 to the switching series-pass transistor 44, thereby alternately switching the transistor 44 between on and off conductive states.

Figure 3:
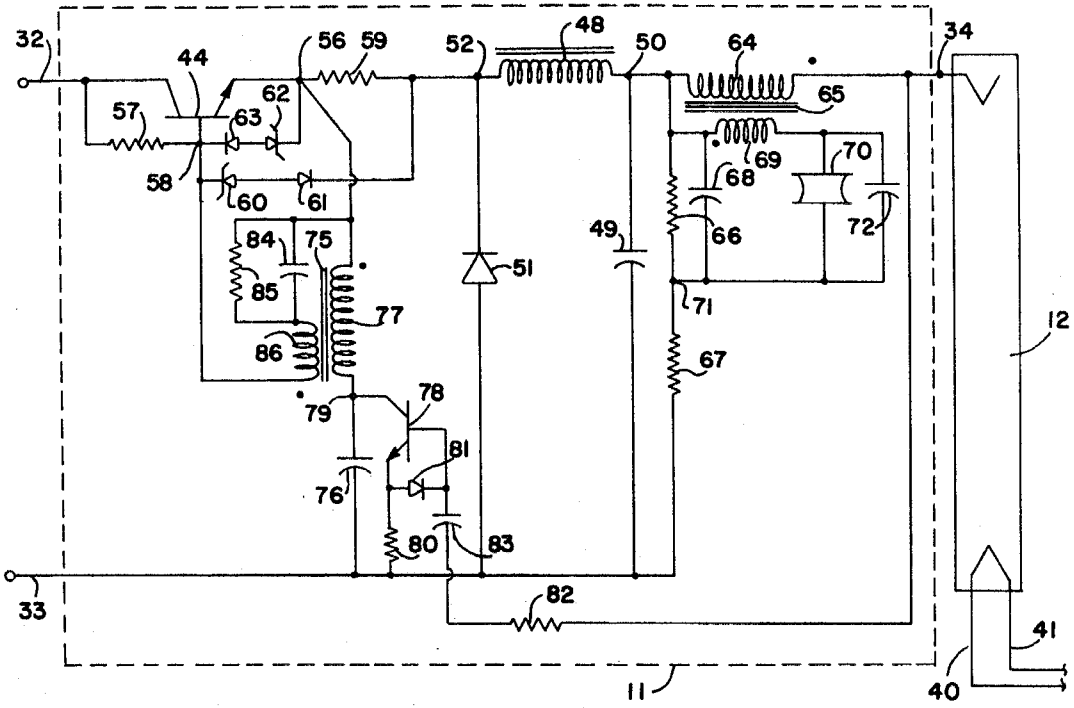
FIG. 3 is a schematic circuit diagram of the preferred embodiment of a D.C. ballasting and starting circuit for supplying power to a gaseous discharge tube.

FIG. 3 illustrates the preferred embodiment of the D.C. ballasting and starting circuit 11 of FIGS. 1 and 2. A series-pass switching transistor 44, of the NPN type, is connected in series between the input line 32 and a junction 56. The collector terminal of the transistor 44 is connected to the junction 56. A resistor 57 is connected from the input line 32 to a junction 58. The base terminal of the transistor 44 is also connected to the junction 58 such that the transistor receives base drive from the resistor 57 to normally bias the transistor 44 in an on conductive state.

Connected in series between the junctions 52, 56 is a resistor 59, of low ohmic value, for sensing the current delivered by the transistor 44. A series combination of a zener diode 60 and a rectifying diode 61 are connected between the junction 52 and the junction 58. The zener diode 60 has its cathode terminal connected to the junction 58 while the rectifying diode 61 has its cathode terminal at the junction 52. When the current through the current sensing resistor 59 establishes a potential thereacross which exceeds the zener voltage of the zener diode 60, the zener diode 60 begins conduction and diverts base current drive delivered by the resistor 57 and by an oscillator winding 86 away from the base of the transistor 44. The diode 61 compensates for both the potential drop by the forward-biassed base-emitter junction of the transistor 44 and also for temperature variation thereof. Thus, the combination of the resistor 59, the zener diode 60 and the rectifying diode 61, limits the maximum current which the switching transistor 44 may conduct. In fact, in steady-state operation of the circuit 11, the switching transistor 44 is repeatedly switched to the off conductive state upon reaching a predetermined current level. The transistor 44 however receives sufficient base drive that it operates near the saturation region before delivering the limited current. Thus, although the transistor 44 delivers significant power to the junction 56 during its on conductive states, because of the low collector to emitter drop across the transistor 44, power dissipation in the transistor 44 is minimal. Of course, during off conductive states of the transistor 44, no current is conducted therethrough and no power dissipation therein occurs.

A series combination of another zener diode 62 and another rectifying diode 63 are connected between the junctions 56, 58 across the base-emitter junction of the transistor 44. The zener diode 62 has its cathode terminal connected to the emitter of the transistor 44 while the rectifying diode has its cathode terminal connected to the base of the transistor 44. The diodes 62, 64 prevent reverse voltage breakdown of the base-emitter junction of the transistor 44 due to signals applied to the base of the transistor 44 by the oscillator circuit. The zener diode 62 also reduces oscillator loading during off conductive states of the transistor 44.

An inductor 48 is connected in series with the current sensing resistor 59 between the junctions 52 and 50. A capacitor 49 is connected between the junction 50 and the second input line 33. The combination of the series inductor 48 and the parallel capacitor 49 comprise a filter to smooth the pulses of energy delivered by the switching transistor 44 at the junction 52. The voltage at the junction 50 is primarily D.C. with a small amount of ripple superimposed thereon. The small voltage ripple at the point 50 is due to the fact that the filter comprised of the inductor 48 and the capacitor 49 is not an ideal filter.

Connected between the junction 52 on the opposite side of the inductor 48 and the second input lead 33 is a commutating diode 51. The commutating diode 51 has its cathode terminal connected to the junction 52. Continuity of current through the inductor 48 during the off conductive state of the transistor 44 is provided by the commutating diode 51. However, during the on conductive state of the transistor 44 the commutating diode 51 is reverse-biassed and non-conductive.

Due to considerations of power efficiency and rapid switching, as are more fully discussed hereinafter the commutating diode 51 must have fast recovery times when switching between conductive states. A suitable diode is commercially available from Varo, Inc., Garland, Tex. 74040, as part number V334X and has 3 ampere, 400 volt ratings.

Connected in series between the junction 50 and the output terminal 34 is a secondary winding 64 of a pulse transformer 65. The secondary winding 64 does not interfere with passage of direct current therethrough to the lamp 12. However, the secondary winding 64 is capable of delivering a starting pulse of sufficient magnitude and duration which, when added to the potential already at the junction 50, provides a sufficient potential at the output terminal 34 to initiate ionization and the striking of an arc between the electrodes of the lamp 12. The starting circuit further has a pair of voltage dividing resistors 66 and 67 connected between the junction 50 and the second input line 33. Energy storage means in the form of a capacitor 68 is connected in parallel with the resistor 66. A primary winding 69 of the pulse transformer 65 has one end connected to the junction 50. Another end of the primary winding 69 is connected through a spark gap 70 to another junction 71 between the voltage dividing resistors 66 and 67. Connected in parallel across the spark gap 70 is a second capacitor 72 which is of greater capacitance than the energy storage capacitor 68. The spark gap 70 is a voltage threshold sensitive device, which is nonconductive for voltages across the resistor 66 which are below its threshold voltage. Upon exceeding its threshold voltage, the spark gap 70 assumes a very low impedance characteristic if provided with sufficient current during initial conduction. The capacitor 72 initially provides sufficient current to insure that the spark gap 70 assumes a low impedance condition to completely discharge the energy storage capacitor 68 through the primary winding 60 of the pulse transformer 65, thereby generating a starting pulse across the secondary winding 64. After discharging the capacitor 68 to a low voltage level, the arcing in the spark gap 70 will extinguish whereupon the spark gap 70 will resume its high impedance, nonconductive state. A suitable spark gap 70 with a threshold voltage level of approximately 90 volts is commercially available from the Siemens Corp., Iselin, N.J. 08830, as part number BI-F90.

If the starting pulse generated across the secondary winding 64 is unsuccessful in striking an arc in the lamp 12, the voltage at a junction 50 will nearly equal that at the input lead 32. The energy storage capacitor 68 will again recharge in approximately one second to the point at which the voltage thereacross exceeds the threshold voltage of the spark gap 70. Thus the starting circuit will continue to generate starting pulses until ionization is established in the lamp 12. Unless the lamp 12 is defective or some other circuit malfunction is present, the starting circuit will usually energize the lamp 12 when the first starting pulse is generated. When arcing in lamp 12 commences, the D.C. potential at the junction 50 and at the output terminal 34 will drop to a potential which is determined by the load characteristics of the lamp 12. That is, the ballasting and starting circuit 11 begins to operate in a current-regulated output mode.

The means for controlling the on and off states of the series-pass transistor 44 is provided by an oscillator circuit. As shown in FIG. 3, the oscillator circuit has a resonant tank circuit consisting of a transformer 75 and a capacitor 76. A primary winding 77 of the transformer 75 is connected in series with the capacitor 76 between the junction 56 and the second input line 33. A transistor 78 momentarily excites the resonant tank circuit when the starting pulse is generated at the output terminal 34. Thereafter, the tank circuit interacts with the transistor 44 to remain in a self-oscillating condition. The transistor 78 has a collector terminal connected to a junction 79 between the primary winding 77 and the capacitor 76. An emitter terminal of the transistor 78 is referenced to the second input line 33 through a resistor 80. A diode 81 is connected between the emitter and base terminals of the transistor 78, with the cathode of the diode 81 connected to the base of the transistor 78, to prevent reverse voltage breakdown of the base-emitter junction of the transistor 78 and to recharge a capacitor 83 through the resistor 80 to prepare the circuit for a subsequent starting pulse, if necessary. A series combination of a resistor 82 and a capacitor 83 are connected between the base of the transistor 78 and the output terminal 34. The oscillator circuit is thus insensitive to the D.C. level at the output terminal 34, but is instantaneously excited when the starting voltage pulse appears at the output terminal 34. The transistor 78 momentarily conducts current through winding 77 thereby generating base drive for the transistor 44 across the winding 86. Resistor 80 limits peak current conducted through the winding 77. Transistor 78 only conducts during the starting pulse which, however, has the after-effect of causing the resonant tank circuit to ring for a sufficient number of cycles to cause transistor 44 to begin self-oscillating at the natural resonant frequency of the tank circuit including winding 77 and capacitor 76. A parallel combination of a capacitor 84 and a resistor 85 are connected in series with a secondary winding 86 of the resonant transformer 75, which is in turn connected across the base and emitter terminals of the series-pass switching transistor 44. The secondary winding 86 applies the oscillator output signal across the base-emitter junction of a series-pass switching transistor 44, thereby alternately driving the transistor 44 into an on conductive state. When the level of the transistor output signal across the secondary winding 86 rises, the oscillator will reverse bias the base-emitter junction of the transistor 44 which will cause the transistor 44 to assume an off conductive state. At the same time, the secondary winding 86 will conduct any base drive through the resistor 57 away from the transistor 44.

A parallel combination of the capacitor 84 and the resistor 85 provide an R-C phase-shifting network in series with the secondary winding 86. The R-C network phase compensates the oscillator output signal for phase-shifts caused by other circuit components, and under normal operating conditions produces 70 percent on period and 30 percent off period for the switching transistor 44.

The resonant frequency of the oscillator circuit will determine the frequency at which the switching resistor 44 operates. Higher operating frequencies are preferred because the inductor 48 may be of less inductance and the capacitor 49 of less capacitance and still maintain the peak-to-peak ripple voltage appearing at the output terminal 34 below permissible levels. Lower inductive and capacitive values mean that the inductor 48 and the capacitor 49 of the filter means will be of smaller physical size and usually of a lower cost. However, limitation on the maximum frequency which the oscillator should operate is imposed by power loss considerations in the switching transistor 44 and in the commutating diode 51. As previously noted, very little power dissipation occurs in the series-pass transistor 44 when the transistor 44 is in an on conductive state because it is operating in the saturation region, i.e. a very low collector to emitter voltage drop. No power dissipation occurs in the series-pass transistor 44 when it is in an off conductive state, because there is no current passing therethrough. Similarly, the commutating diode 41 experiences no power dissipation when in an off conductive mode, and very little power dissipation when in an on conductive mode because the voltage drop thereacross is only that of a forward-biassed diode junction.

However, both the transistor 44 and the diode 51 have finite turn-on and turn-off time periods. When the operating frequency of the circuit becomes high enough that the turn-on and turn-off times of the transistor 44 and the diode 51 become an appreciable portion of the time period associated with the operating frequency, the power losses in both the transistor 44 and the diode 51 also become appreciable. A suitable operating frequency at which the size and cost of the inductor 48 and the capacitor 49 are minimized but which is also low enough to avoid appreciable switching losses in the transistor 44 and in the diode 51 is in the vicinity of 20 kiloHertz.

Various other forms of control and drive means for the series-pass switching transistor 44 will become apparent to those skilled in the art besides the oscillator circuit illustrated in FIG. 3 as disclosed in said application (the entire disclosure of which is hereby incorporated herein by this reference).

For proper operation of the circuitry disclosed above and in the various drawings, selection and design of the various magnetic components is important. For example, if the switching transistor 44 is to operate near the 20 kiloHertz range, powdered ferrite cores are preferred. The magnetic components may utilize pairs of "E" cores with the legs of the pairs of "E" cores butted together. Air gaps of various widths are also employed. For example, the inductor 48 typically has 400 turns of #28 copper wire wound on a pair of "E" cores with a 0.020 inch air gap between the legs of the "E" cores. Suitable cores are commercially available from Ferroxcube Corp., Saugerties, N.Y. 12477 as part number 782E272-3E2A.

Similarly, the transformer 75 has a primary winding 77 of 134 turns of #39 wire and a secondary winding of 8 turns of #29 wire with a 0.005 inch air gap between a pair of "E" cores of part number 206F440-3E2A (Ferroxcube). The pulse transformers 65, 145 have a primary winding 69, 152 of 9 turns of #23 wire and a secondary winding 64, 144 of 200 turns of #26 wire with a 0.010 inch air gap between pairs of "E" cores of part number 782E272-3E2A (Ferroxcube).

It will be understood that various changes and modifications can be made without departing from the spirit of the invention as defined in the following claims, and equivalents thereof.

We claim:

1. In a system for operating a gaseous discharge lamp from direct current ballasting and starting circuitry, a power conversion circuit for converting alternating current voltage to suitable direct current voltage for said ballasting and starting circuitry, said power conversion circuit comprising:

a power transformer;

a primary winding on said transformer, said primary winding having a tap connected to a portion of said primary winding, said portion of the primary winding being adapted for applying alternating current input voltage thereacross, whereby the alternating current voltage is stepped-up in potential across the entire primary winding;

rectification means for rectifying the alternating current voltage appearing across the entire primary winding;

filtering means connected to said rectification means for filtering the rectified alternating current voltage supplied by said rectification means to provide a direct current voltage at a pair of output terminals across said filtering means to at least one ballasting and starting circuitry;

a secondary winding of said transformer having a center-tap, said center-tap referenced to one of said pair of output terminals of said filtering means, with the ends of said secondary winding providing an alternating current voltage suitable for connection to a cathodic heater element of said lamp, whereby said lamp operates on direct current supplied by rectification of said primary winding and which returns to said primary winding through said secondary winding, the center-tap thereof, and said rectification means, while heating the lamp with alternating current voltage does not cause alternating current voltage modulation of the D.C. regulated current through said lamp.

2. The power conversion circuit as claimed in claim 1 wherein said rectification means comprises a full-wave diode rectification bridge, and said filtering means comprises at least one capacitor.

* * * * *